US006032746A

United States Patent [19]

Lowery

[11] Patent Number: 6,032,746

[45] Date of Patent: Mar. 7, 2000

[54] ROAD LEVELLER

[76] Inventor: Lloyd Lowery, 7420 Highway No. 115/35 R.R. #1, Orono, Ontario, Canada, L0B 1M0

[21] Appl. No.: 09/134,911

[22] Filed: Aug. 17, 1998

[51] Int. Cl.[7] ..... A01B 59/043

[52] U.S. Cl. ..... 172/445.1; 172/448; 172/684.5; 172/779; 172/799.5

[58] Field of Search ..... 172/797, 779, 172/445.1, 255, 274, 448, 449, 779.5, 684.5, 789; 280/43.23, 460.1, 461.1

[56] References Cited

U.S. PATENT DOCUMENTS

| | | | |
|---|---|---|---|
| 2,254,414 | 9/1941 | Bowlin . | |
| 2,687,681 | 8/1954 | Phenice . | |
| 2,722,876 | 11/1955 | London | 172/448 |
| 2,732,640 | 1/1956 | Kirchner | 172/4.5 |
| 2,862,341 | 12/1958 | Miller | 172/445.1 X |
| 2,994,977 | 8/1961 | Shumaker et al. . | |
| 3,090,141 | 5/1963 | Shumaker . | |
| 3,092,922 | 6/1963 | Knapp et al. . | |
| 3,174,557 | 3/1965 | Newkirk | 172/448 |
| 3,225,836 | 12/1965 | Newkirk | 172/448 |
| 3,234,669 | 2/1966 | Kachnick et al. | 172/448 |
| 4,236,587 | 12/1980 | Shader et al. . | |
| 4,239,251 | 12/1980 | Rocksvold . | |
| 4,299,290 | 11/1981 | Nunes, Jr. | 172/445.1 X |
| 4,817,730 | 4/1989 | Winter | 172/448 X |
| 4,903,781 | 2/1990 | Smit | 172/449 X |
| 5,228,522 | 7/1993 | Stufflebeam et al. | 172/448 X |
| 5,289,880 | 3/1994 | Barto | 172/684.5 X |

*Primary Examiner*—Victor Batson

[57] ABSTRACT

A bogie is attached to a three point hitch of a tractor and serves to control the up and down movement of a scraper blade. The bogie comprises an articulated frame having a pair of spaced side rails each connected to a separate lower link of the hitch. An intermediate arm is supported by the side rails and has means for connection to the upper link of the hitch. A castor is mounted for swivelling in a wheel housing and is raised and lowered by means of an hydraulic actuator.

6 Claims, 4 Drawing Sheets

FIG. 4.
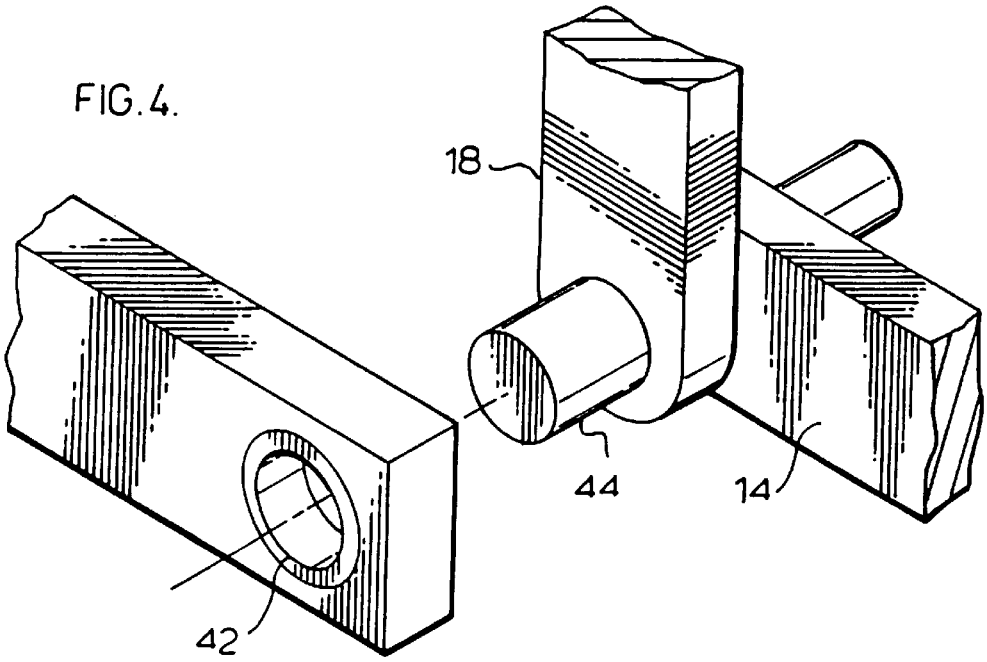
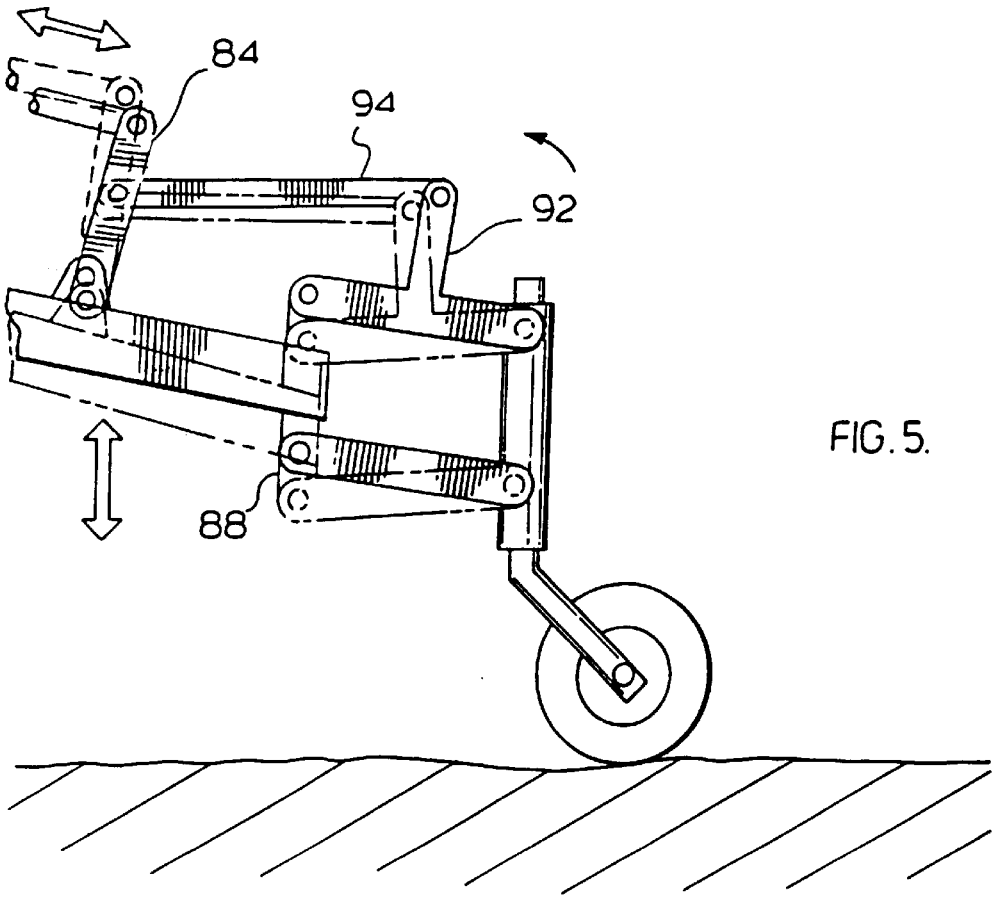
FIG. 5.

ROAD LEVELLER

BACKGROUND OF THE INVENTION

This invention relates generally to implements for grading land and more particularly to a bogie for use in conjunction with a conventional scraper blade for maintaining the blade at a predetermined level.

It is conventional to grade or flatten uneven terrain by means of a scraper blade drawn by a tractor. Such means is generally effective where there are abrupt humps or pot holes in the ground. Should however there be slight undulations in the ground but otherwise free of humps or potholes, the blade may not be very effective. In fact a blade may actually enlarge slight dips. The reason for this is that as the blade reaches a depression, gravity will cause it to enter the depression and as it does the blade will scrape a layer from the bottom of the depression thereby deepening it.

If the depression is abrupt, such as a pothole, it will be visible to the operator of the tractor and he will be able to lift the blade to prevent the blade from enlarging it. If however the depression is only slight, the operator may not be aware of it and if he fails to lift the blade before the blade reaches it, the blade may enlarge it. As a result, slightly undulating ground may be much rougher after it has been scraped than it was before.

Bogies are known for preventing a blade which is drawn by a tractor from entering a depression. Examples of such bogies are described in a number of U.S. patents including U.S. Pat. No. 2,254,414 to Bowlin; U.S. Pat. No. 2,687,681 to Phenice; U.S. Pat. No. 2,994,977 to Shumaker et al; U.S. Pat. No. 3,090,141 to Shumaker; U.S. Pat. No. 3,092,922 to Knapp et al.; U.S. Pat. No. 4,236,587 to Shader et al.; and U.S. Pat. No. 4,239,251 to Rocksvold.

Known bogies such as those described in the above-noted patents have a number of shortcomings. Some, for example, are only one of a combination of various components. Such combinations may include a blade, four or more wheels, a scoop and so on. Such bogies are not intended for use in conjunction with an existing scraper blade. Other bogies must be attached to all three links of a conventional three point hitch and all three of the links must be operable for the bogie to operate as it is intended. Still others require complicated machinery to adjust the components of the bogie.

The bogie of the invention does not share the shortcomings mentioned above. The bogie may be used in conjunction with an existing scraper blade; it does not require that the links of a three point hitch be operable; nor is the means complicated for adjusting the bogie to the conditions of use.

The bogie of the invention controls the up and down movement of a ground-contacting blade attached to a three point hitch at the rear of a tractor. Briefly the bogie comprises an articulated frame having a pair of spaced side rails each having means for connection to a separate lower link of the hitch. An intermediate arm is supported by the side rails and has means for connection to the upper link of the hitch. A castor is mounted for swivelling in a wheel housing. The housing is connected to the intermediate arm. The bogie is equipped with adjusting means for raising and lowering the castor.

DESCRIPTION OF THE DRAWINGS

The bogie of the invention is described with reference to the accompanying drawings in which:

FIG. 4 is an enlarged fragmentary perspective view of the connection between the forward end of the scraper blade with the bogie; and FIG. 5 is an enlarged elevation of the rear portion of the bogie.

Like reference characters refer to like parts throughout the description of the drawings.

DESCRIPTION OF PREFERRED EMBODIMENTS

Figure 1:
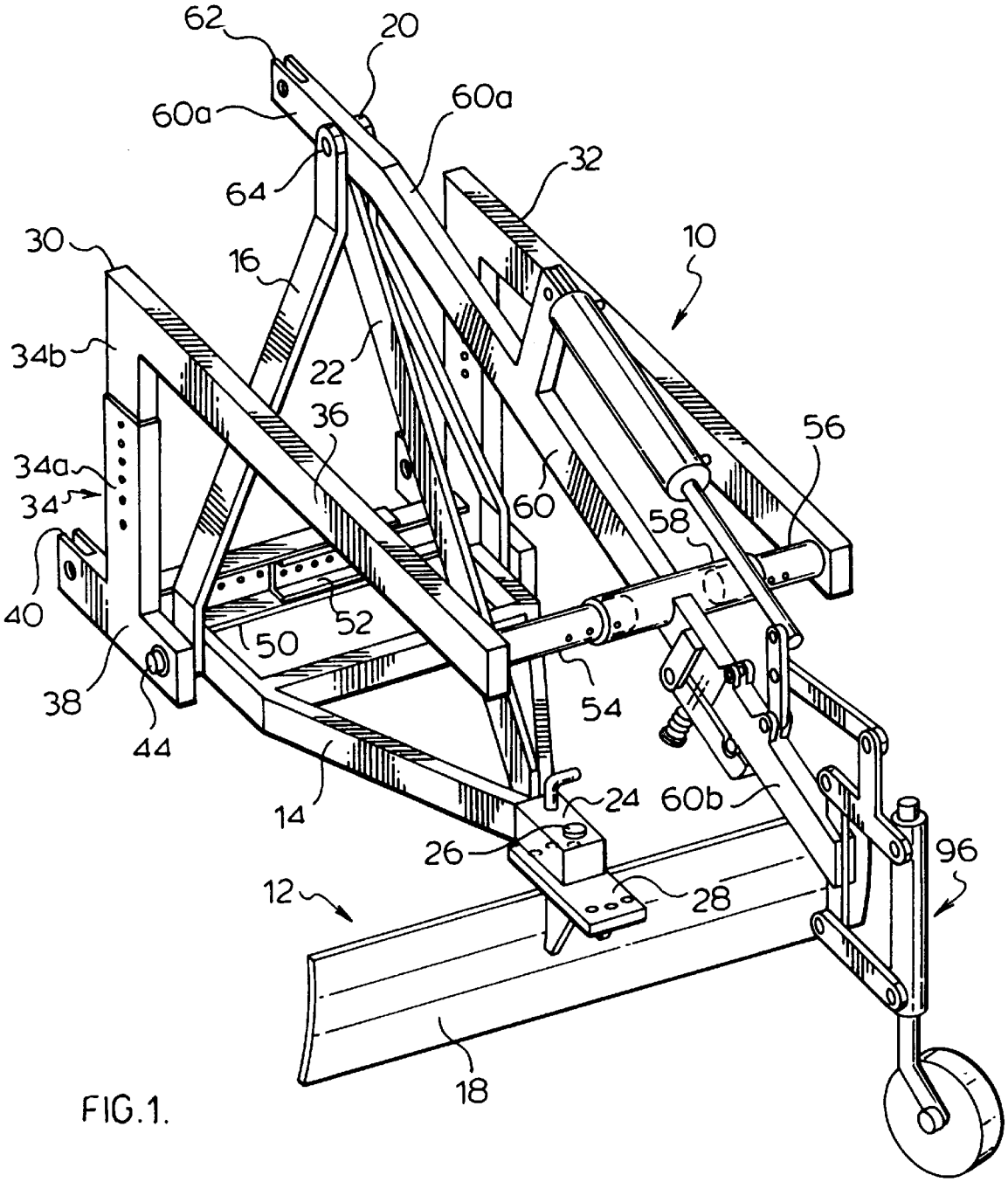
FIG. 1 is a perspective view of the bogie in conjunction with a scraper assembly.

With reference to FIG. 1, the bogie of the invention, generally 10 is shown in conjunction with a conventional scraper assembly, generally 12. The latter assembly includes a horizontal A frame 14 and a vertical V rear frame 16. A ground-contacting or scraper blade 18 is attached to the rear of the A-frame.

The V-frame extends upwardly from the forward end of the A-frame and terminates at an apex 20. Apertures are provided at the apex so that the frame can be connected by means of a steel pin to the upper link of a conventional three-point hitch.

A brace 22 extends downwardly from the apex and terminates at a block 24 at the rear end of the A-frame. The brace is attached to the block by welding.

There is provision for adjusting the angle of the blade by means of a steel pin 26 which fits into preselected openings in block 24 and through corresponding openings in underlying plate 28 which is attached to the blade.

The bogie has a pair of spaced generally L-shaped side rails 30, 32 each having a vertical component 34 and a horizontal component 36. The former component is made up of a hollow lower segment 34*a* and a solid upper segment 34*b*, the latter segment fitting into the former so that the two segments interconnect as illustrated. The effective length of the vertical component of the side rails can be adjusted by means of a steel pin which is inserted into apertures in register with one another when the length of the rails are the required length.

At the lower end of the vertical component is an end section 38 having at one end a clevis 40 for attachment to the lower links of a three point hitch. At the other end of the end section, as illustrated in FIG. 4, an opening 42 is formed for receipt of a pintle 44.

Pintle 44 extends outwardly from the forward end of the A-frame 14 and through an opening in the lower end of the V-frame 16. The pintle serves to interconnect the scraper assembly to the side rails but permits the blade to move up and down relative to the rails.

The distance separating the two side rails 30, 32 can be adjusted by means of two pieces of channel iron 50, 52, each attached to the inside walls of a separate lower end section 38. Channel piece 52 is smaller than piece 50 so that the two pieces fit together as illustrated. Apertures are formed on each piece for receipt of a steel pin. The pin may be inserted into apertures in register with one another when the rails are spaced the required distance apart in order to maintain the two pieces in that position.

At the rear ends of the side rails, cross bars 54, 56 extend toward each other. The free ends of the bars are received in opposite ends of a sleeve 58. Apertures are formed in the cross bars and in the sleeve for receipt of steel pins so that the spacing of the side rails can be changed to allow for adjustment of the lower sections of the rails.

An intermediate arm 60 is located mid-way between the side rails. A clevis 62 is formed at the forward end of the arm for attachment to the upper link of a three-point hitch. To the rear of the clevis is an aperture for receipt of a steel pin 64 for attaching the upper ends of the V-frame to the arm.

Figure 2:
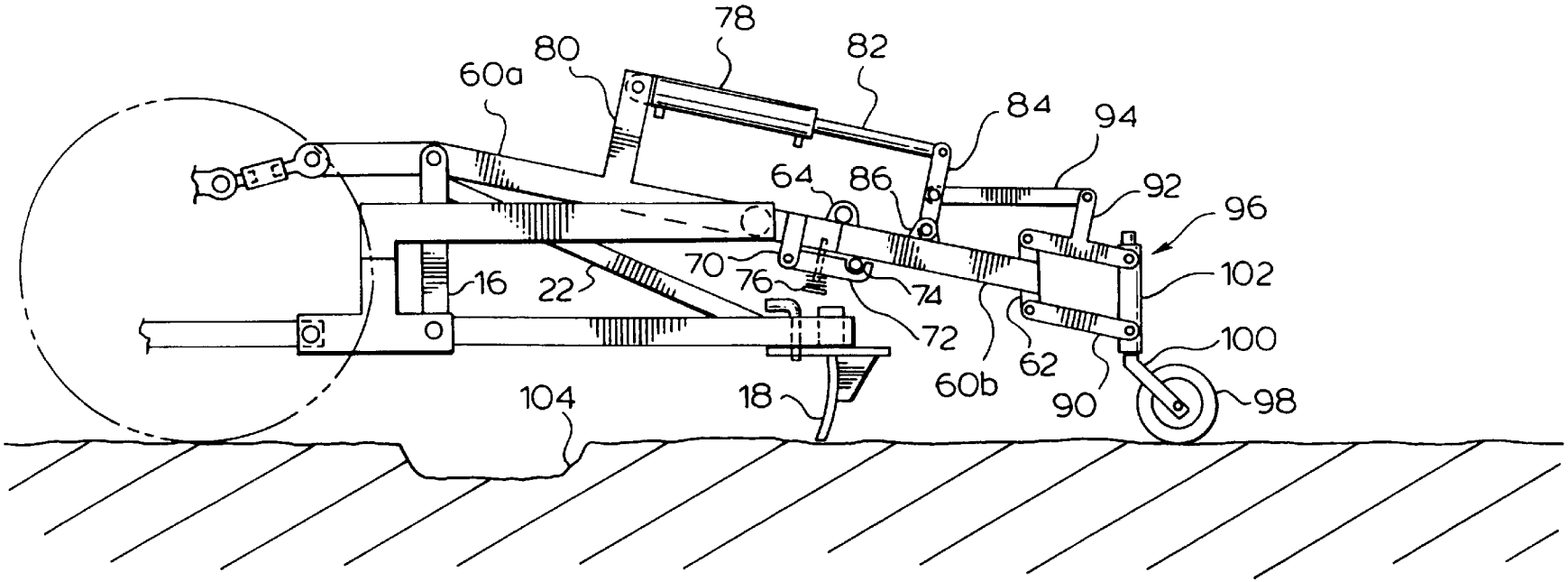
FIGS. 2 and 3 are elevations of the bogie in conjunction with a scraper assembly and a rear wheel of a tractor, the bogie in FIG. 2 being in an operative position and the bogie in FIG. 3 being in an inoperative position.

With reference to FIG. 2, the intermediate arm is made up of forward and rear segments 60*a,b* which slope downward and terminate at a post 62. The two segments are interconnected by means of a hinge 64. When the two segments are in the position illustrated in FIG. 2 their longitudinal axes are aligned with one another An ear 70 extends downwardly from the forward segment and latch 72 is pivotally attached to the ear. At the forward end of the latch a depression is formed for receipt of a catch 74 on the lower wall of the rear segment. A spring loaded pin 76 prevents the latch from opening until the pin is pulled down-ward manually. When however the rear segment is overloaded as explained below, the latch will open notwithstanding that the pin is not pulled downward.

Adjusting means in the form of a hydraulic or pneumatic actuator 78 is maintained above the intermediate arm by means of a support 80 which extends upwardly from the forward segment of the intermediate arm. Piston rod 82 of the actuator is interconnected to the rear segment by means of a first link 84 which is pivotally attached to the piston rod and to ears 86 on the rear segment of the intermediate arm.

When the two segments of the intermediate arm are aligned as illustrated in FIG. 2, the bogie is in an operative position and post 62 is generally vertical. Lower and upper links 90, 92 are pivotally connected to the lower and upper ends of the post. The upper link 92 is generally T-shaped and has an upstanding limb which is pivotally connected to a second link 94. The latter link is pivotally connected to first link 84 midway of its ends.

Links 90, 92 are pivotally connected to a wheel assembly, generally 96. The latter assembly is made up of a castor 98 which is mounted in bearings in a rod 100. The rod is mounted for swivelling in a sleeve 102 and the sleeve in turn is pivotally connected to the two links 90, 92.

With further reference to FIG. 2, the bogie is in position to control the up and down movement of blade 18. Should the blade encounter a depression in its forward path such as at 104, the bogie will prevent the blade from descending into it. That is because the wheel assembly will hold the intermediate arm up and that arm supports the brace 22 and the V-frame 16 of the scraper assembly.

Actuator 78 allows the position of the wheel assembly to be adjusted. Should it be desired, for example, to lower the bogie so that the blade will scrape more material from the ground, the wheel assembly is raised. That is accomplished by causing the piston rod of the actuator to retract. As it does so, first and second links 84 and 94 are drawn toward the actuator thereby causing link 92 to rotate counter-clockwise about post 62. The wheel assembly will rise as link 92 rotates in this direction.

When the piston moves in the opposite direction, the links and wheel assembly will move from the position in broken lines in FIG. 5 to the position in solid lines with resulting lowering of the wheel assembly and a corresponding upward movement of blade 18.

As the wheel assembly is lowered the weight which bears on it increases. But for latch 72, that increased weight would cause the rear segment of the intermediate arm to rotate upward about hinge 64. Should that weight become excessive, catch 74 will snap out of the depression thereby allowing the wheel assembly to swing upward. The latch thus protects the wheel assembly and the remainder of the bogie from over-loading.

Figure 3:
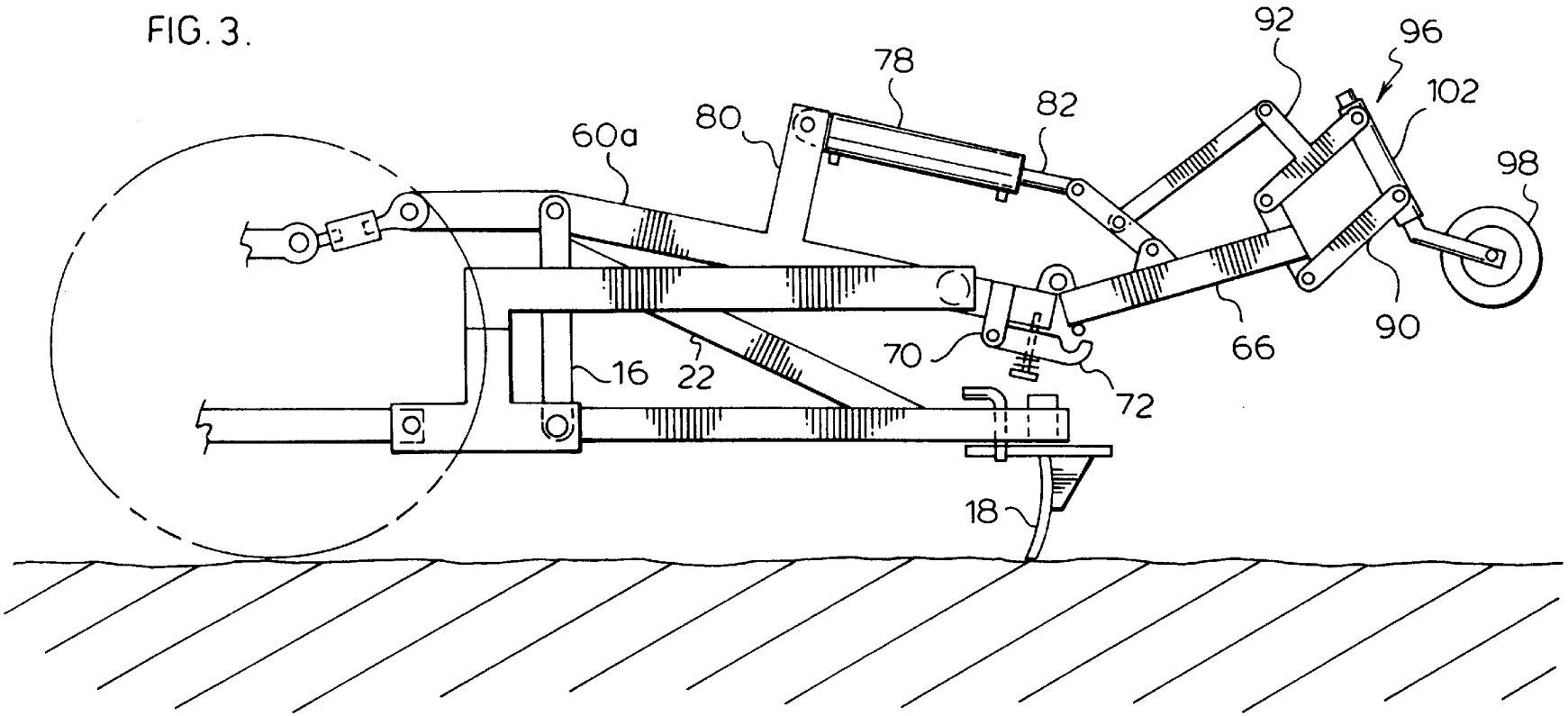

With reference to FIG. 3, the bogie is shown in an inoperative position. The bogie will take that position when piston rod 82 is caused to retract to the illustrated positposition. While the rod is retracting, latch 72 must be opened so that rear segment of the intermediate arm can rotate counter-clockwise.

It will be understood of course that modifications can be made in the preferred embodiments illustrated and described herein without departing from the scope and purview of the invention as defined in the appended claims.

I claim:

1. A bogie for controlling up and down movement of a ground-contacting blade attached to a three point hitch at a rear of a tractor, said hitch having an upper link and a pair of lower links, said bogie comprising: an articulated frame having a pair of spaced side rails each of which having means for connection to a separate said lower link; an intermediate arm supported by said side rails and having forward and rear segments, said forward segment having means for connection to said upper link and said rear segment being attached at one end to said forward segment and at the opposite end to a post, said rear segment being pivotal upwardly from an operative to an inoperative position, the longitudinal axis of said rear segment when in the operative position being aligned with the longitudinal axis of said forward segment, said post being generally vertical when said rear segment is in said operative position; a wheel assembly including a castor connected to a rod mounted for swivelling in a sleeve; a pair of horizontally spaced lower and upper links interconnecting said post and said sleeve.

2. The bogie as claimed in claim 1 wherein said post is generally vertical when said rear segment is in the operative position and said links are vertically spaced to maintain said sleeve generally vertical but allow upward and downward movement thereof.

3. The bogie as claimed in claim 2 including a pneumatic or hydraulic actuator connected to said intermediate arm for causing pivotal movement of said rear segment relative to said forward segment.

4. The bogie as claimed in claim 3 wherein said actuator has a piston interconnected to said rear segment by means of a first link, said first link being pivotal about said rear segment and said piston.

5. The bogie as claimed in claim 1 further including a cross bar extending between said side rails for maintaining said rails in a spaced parallel relation, said cross bar including a sleeve to which said intermediate arm is connected and a pair of rods each of which being connected to a separate said side rail and received in opposite ends of said sleeve.

6. The bogie as claimed in claim 1 wherein said side rails are vertically adjustable.

* * * * *